US010429124B2

(12) United States Patent
Seo et al.

(10) Patent No.: US 10,429,124 B2
(45) Date of Patent: Oct. 1, 2019

(54) REFRIGERATOR

(71) Applicant: Samsung Electronics Co., Ltd., Suwon-si (KR)

(72) Inventors: Yong Bum Seo, Hwaseong-si (KR); Keon Pyo Koo, Hwaseong-si (KR); Chun Youp Shin, Suwon-si (KR); Woo Yeol Yoo, Suwon-si (KR); Jeong Hyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/523,217

(22) PCT Filed: Aug. 31, 2016

(86) PCT No.: PCT/KR2016/009686
§ 371 (c)(1),
(2) Date: Apr. 28, 2017

(87) PCT Pub. No.: WO2017/039296
PCT Pub. Date: Mar. 9, 2017

(65) Prior Publication Data

US 2018/0187951 A1 Jul. 5, 2018

(30) Foreign Application Priority Data

Sep. 1, 2015 (KR) ..... 10-2015-0123375

(51) Int. Cl.
*F25D 23/02* (2006.01)
*F25D 29/00* (2006.01)
*H04R 5/02* (2006.01)

(52) U.S. Cl.
CPC ..... *F25D 23/028* (2013.01); *F25D 23/02* (2013.01); *F25D 29/008* (2013.01); *H04R 5/02* (2013.01);
(Continued)

(58) Field of Classification Search
CPC ..... F25D 29/008; F25D 2323/02; F25D 2400/36; F25D 23/028; F25D 23/02;
(Continued)

(56) References Cited

U.S. PATENT DOCUMENTS 3,970,782 A * 7/1976 Fenne ..... H04N 5/64 348/839
5,447,041 A * 9/1995 Piechota ..... A45C 11/20 206/542
(Continued)

FOREIGN PATENT DOCUMENTS

CN 206739732 * 12/2017
CN 107726718 * 2/2018
(Continued)

OTHER PUBLICATIONS

Korean Office Action dated Oct. 30, 2017 in Korean Patent Application No. 10-2015-0123375.
(Continued)

*Primary Examiner* — Janet M Wilkens
(74) *Attorney, Agent, or Firm* — Staas & Halsey LLP

(57) ABSTRACT

Disclosed herein is a refrigerator, which includes a main body having an opening, and including a storage chamber therein, a door configured to open or close the opening and a speaker assembly disposed in the bottom of the door, and configured to output sound to the outside. With this configuration, it is possible to minimize exposure of the speaker to thereby reduce influences by an external environment.

13 Claims, 8 Drawing Sheets

(52) U.S. Cl.
CPC .... *F25D 2323/02* (2013.01); *F25D 2400/361* (2013.01)

(58) Field of Classification Search
CPC ..... F25D 29/005; H04R 5/02; H04R 1/025; H04R 1/02
USPC ..... 312/405, 405.1, 321.5, 326–328
See application file for complete search history.

(56) References Cited

U.S. PATENT DOCUMENTS 5,583,743 A * 12/1996 Levins ..... G06F 1/1605 181/199
5,978,211 A * 11/1999 Hong ..... F16M 11/10 361/679.06
6,098,411 A * 8/2000 Jeon ..... F25D 29/005 236/94
6,525,927 B1 * 2/2003 Sugai ..... G06F 1/1616 312/223.1
7,654,622 B2 * 2/2010 Nutt ..... B60R 11/02 296/37.7
7,707,846 B2 * 5/2010 Trulaske, Sr. ..... A47F 3/04 248/692
2004/0100123 A1 * 5/2004 Shea ..... B60R 11/0217 296/156
2004/0251078 A1 * 12/2004 Kung ..... G06F 1/181 181/199
2004/0264728 A1 * 12/2004 Sperle ..... H04N 5/642 381/386
2006/0226745 A1 * 10/2006 Kimura ..... G03G 15/5016 312/293.1
2007/0056306 A1 3/2007 Trulaske, Sr. et al.
2008/0165998 A1 * 7/2008 LeClear ..... D06F 39/00 381/345
2010/0320890 A1 12/2010 Jung et al.
2015/0115790 A1 * 4/2015 Ogg ..... F25D 23/069 312/404
2015/0145399 A1 * 5/2015 Joo ..... F25D 23/02 312/404
2016/0137106 A1 * 5/2016 Subat ..... B60R 11/0217 381/389
2016/0138853 A1 * 5/2016 Kim ..... F25D 23/028 312/405
2016/0178276 A1 * 6/2016 Park ..... F25D 29/005 345/173
2017/0248363 A1 * 8/2017 Eicher ..... F21V 23/0471
2017/0261248 A1 * 9/2017 Koo ..... F25D 17/04
2017/0318609 A1 * 11/2017 Byrne ..... H04M 1/6033
2017/0325019 A1 * 11/2017 Bezzola ..... H04R 1/345
2017/0370636 A1 * 12/2017 Koo ..... F25D 29/005
2018/0031312 A1 * 2/2018 Kim ..... F25D 23/028
2018/0187955 A1 * 7/2018 Son ..... E05D 11/1014

FOREIGN PATENT DOCUMENTS

EP 2631576 * 8/2013
EP 3276287 * 1/2018
JP 1-163587 A 6/1989
JP 02101371 * 4/1990
JP 2004085071 * 3/2004
KR 10-0764279 10/2007
KR 10-2007-0106118 11/2007
KR 10-2013-0012874 2/2013
KR 10-2014-0021228 2/2014
WO 2014038190 * 3/2014

OTHER PUBLICATIONS

Korean Notice of Allowance dated Dec. 5, 2017 in Korean Patent Application No. 10-2015-0123375.
Extended European Search Report dated Jun. 7, 2018 in corresponding European Patent Application No. 16842262.4, 7 pgs.
Korean Office Action dated Jul. 25, 2017 in corresponding Korean Patent Application No. 10-2015-0123375, 8 pages.
International Search Report dated Nov. 24, 2016 in corresponding International Patent Application No. PCT/KR2016/009686, 4 pages.

* cited by examiner

[Fig. 1]
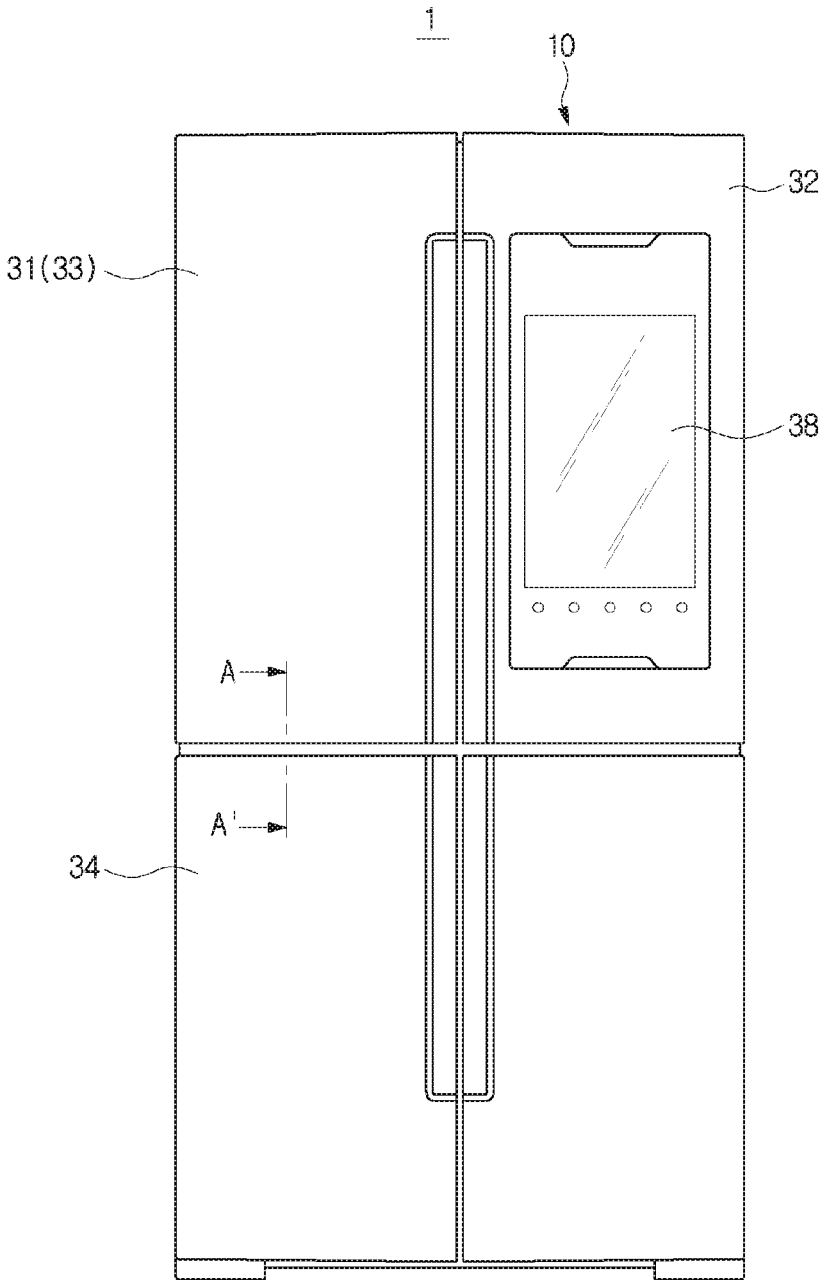

[Fig. 2]
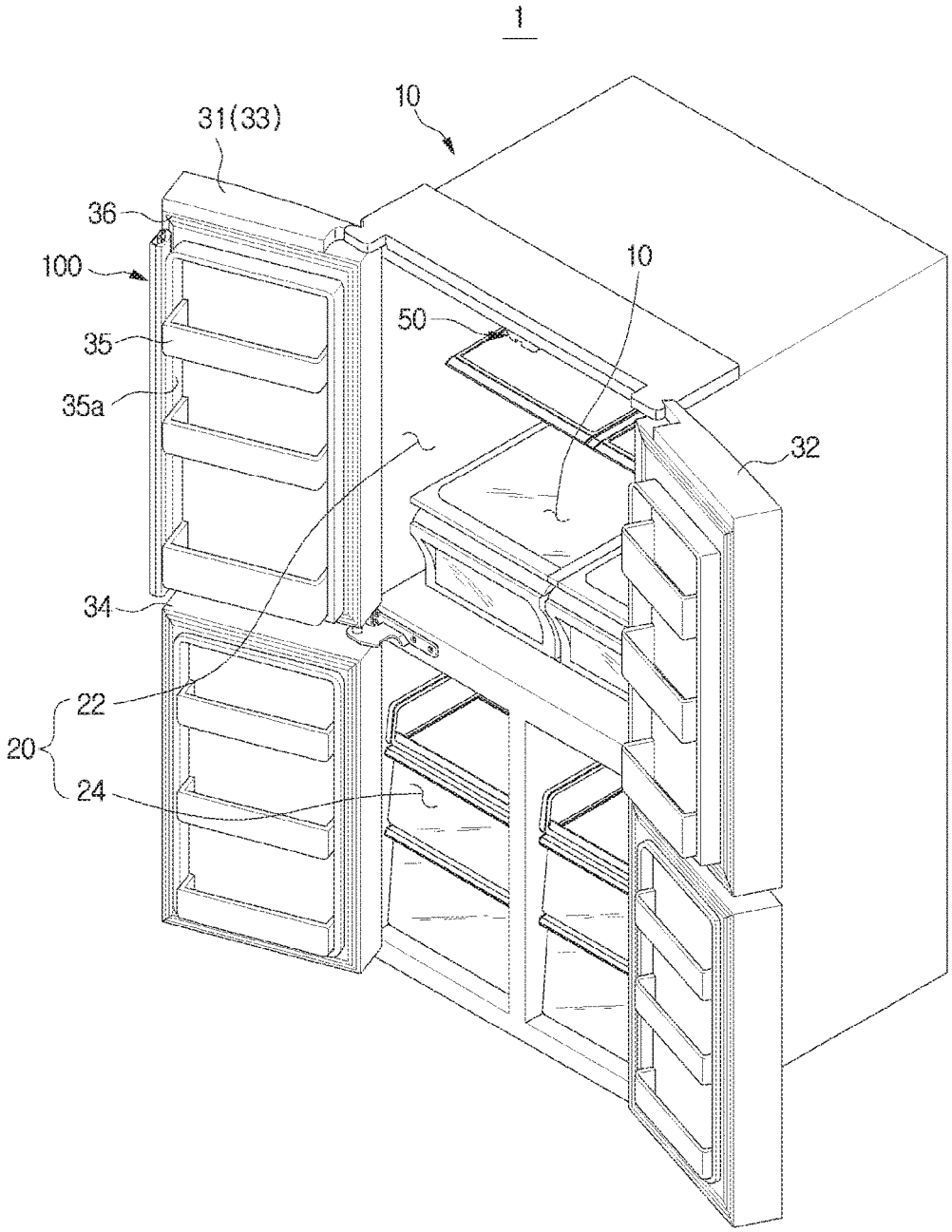

[Fig. 3]
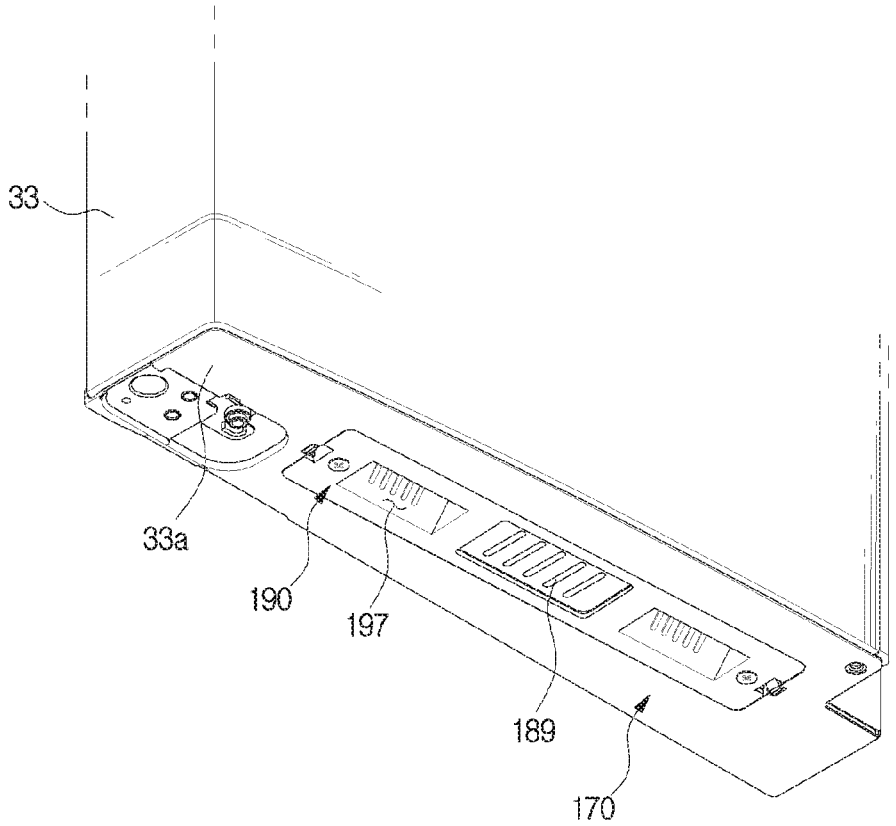

[Fig. 4]
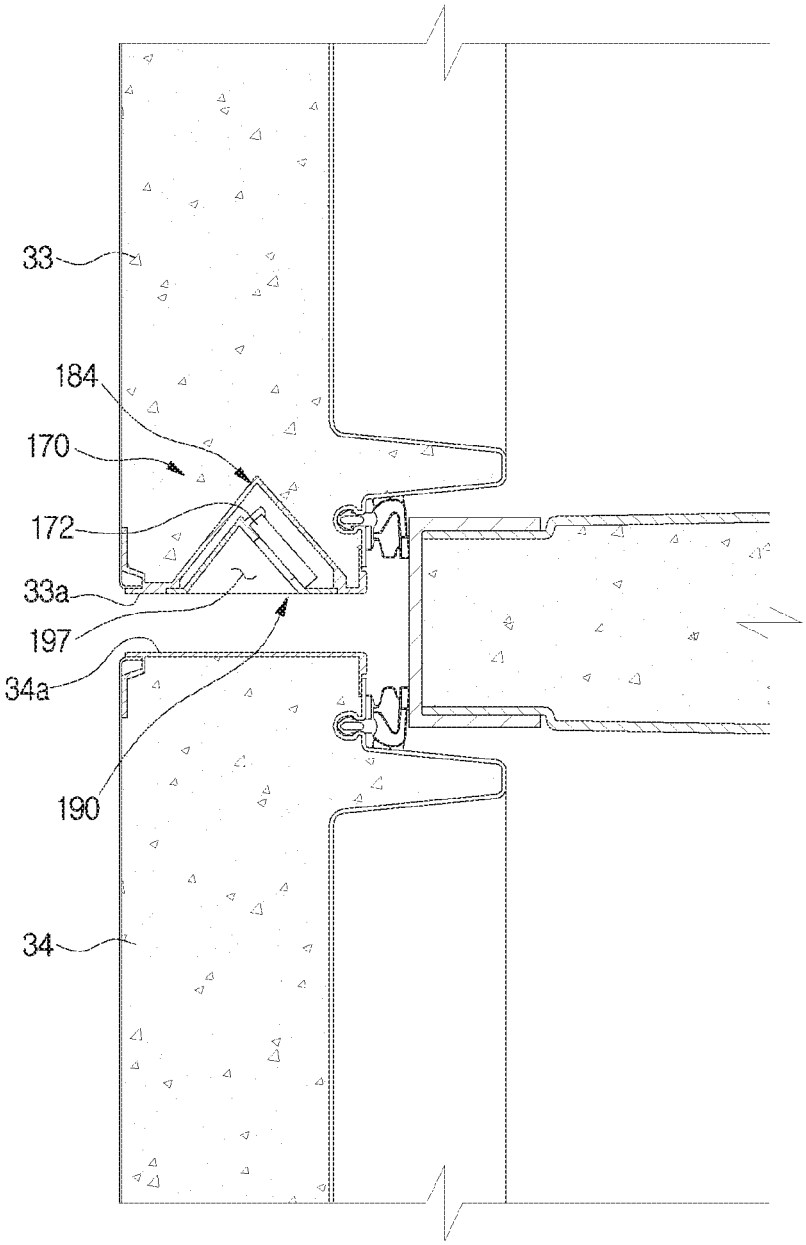

[Fig. 5]
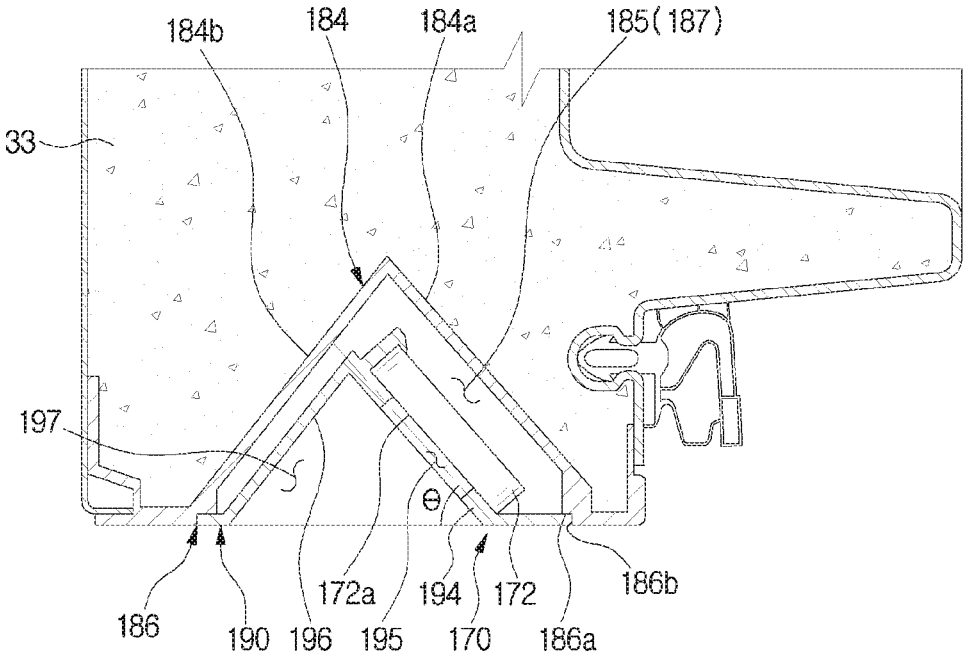

[Fig. 6]
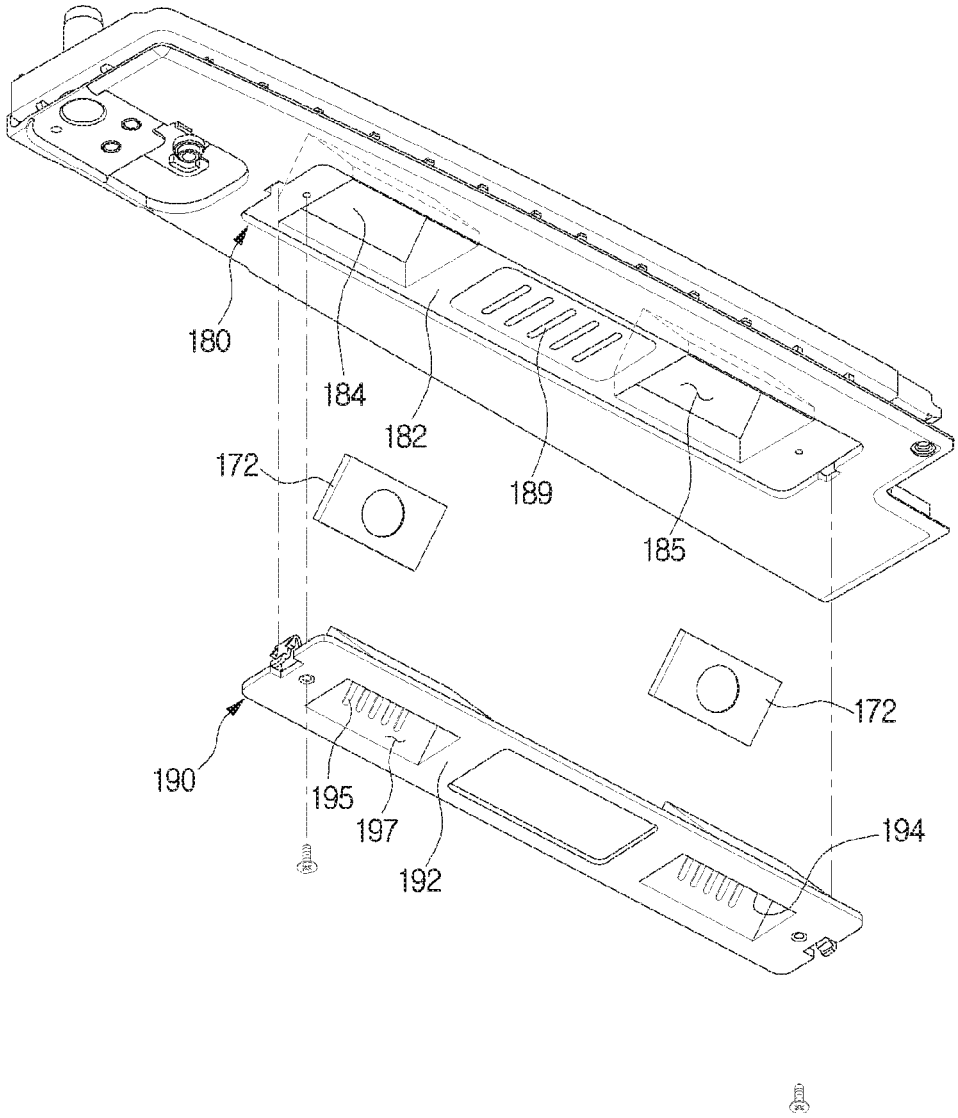

[Fig. 7]
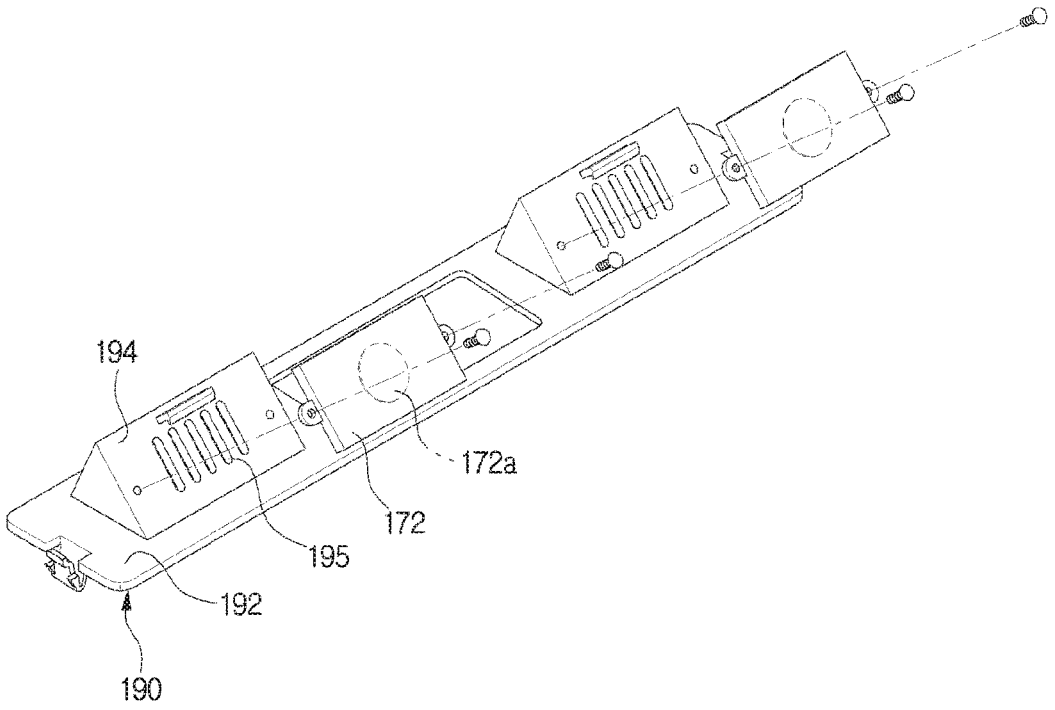
[Fig. 8]
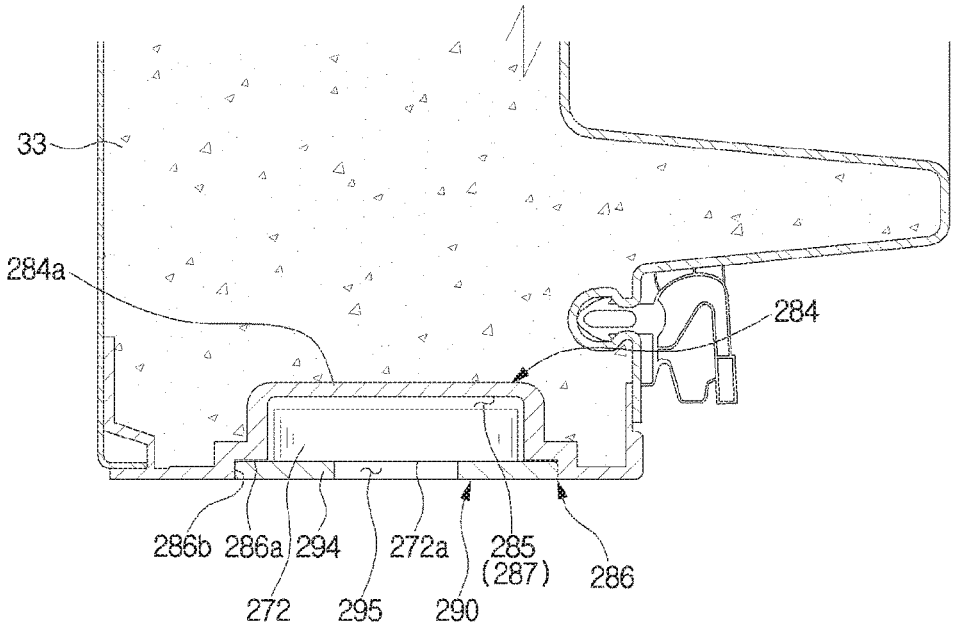

[Fig. 9]
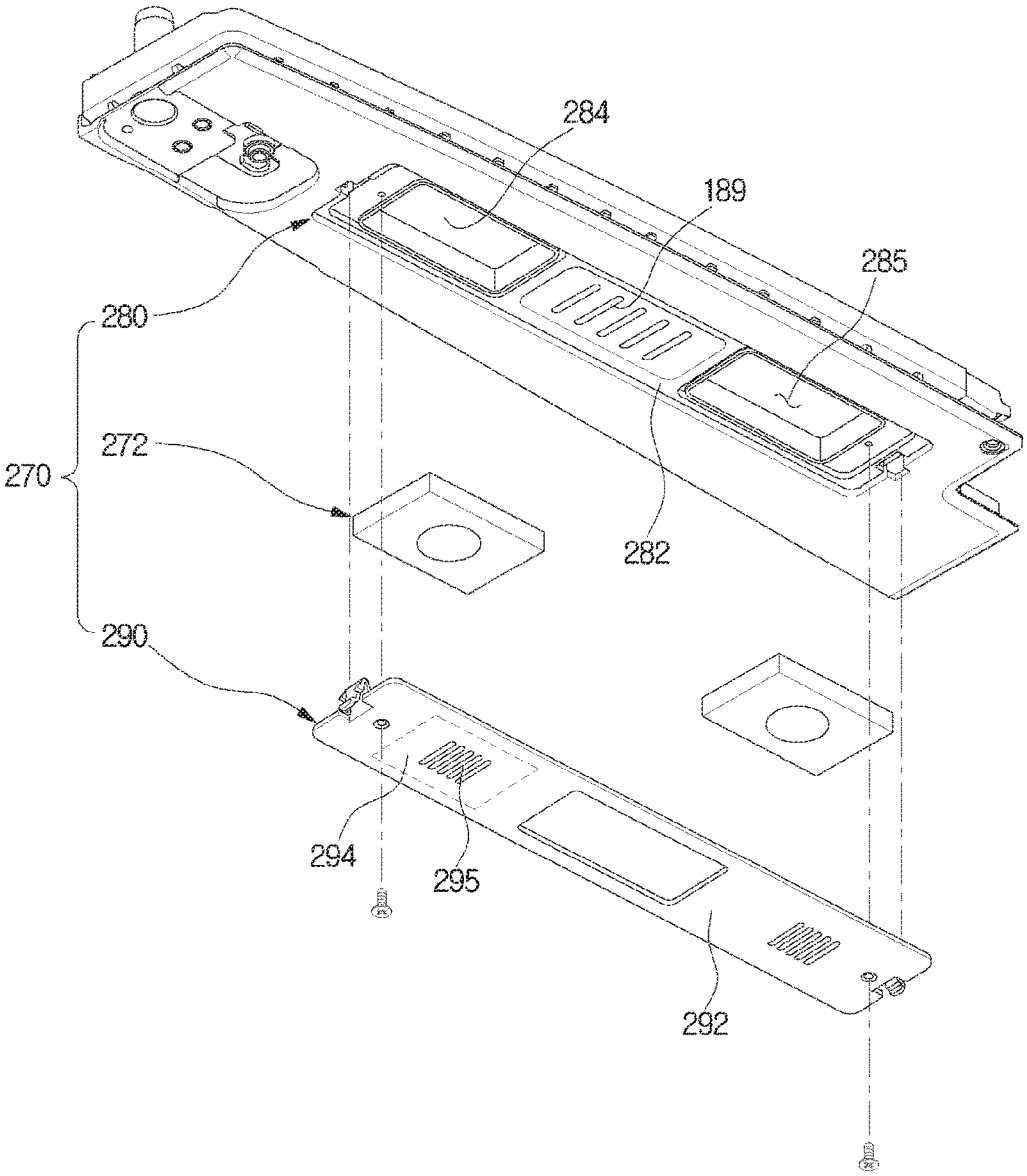

REFRIGERATOR

CROSS-REFERENCE TO RELATED APPLICATIONS

This application is a U.S. National Stage Application, which claims the benefit under 35 U.S.C. § 371 of PCT International Patent Application No. PCT/KR2016/009686, filed Aug. 31, 2016 which claims the foreign priority benefit under 35 U.S.C. § 119 of Korean Patent Application No. 10-2015-0123375, filed Sep. 1, 2015, the contents of which are incorporated herein by reference.

TECHNICAL FIELD

The present invention relates to a refrigerator, and more particularly, to a refrigerator having sound equipment.

BACKGROUND ART

In general, a refrigerator is a home appliance including a storage chamber for storing food, and a cool-air supply apparatus for supplying cool air to the storage chamber, to store food fresh.

Typical refrigerators could perform only a function of storing food at low temperature. However, recently, a need for additional functions, in addition to the function of storing food, is increasing.

The refrigerator may include a speaker capable of generating various kinds of warning sound, or interworking with an imaging apparatus such as a LCD installed in the refrigerator to generate sound. However, the speaker, which is an apparatus for transforming electrical signals into sound waves, needs to communicate with the outside in order to transfer sound waves. However, since the refrigerator is often exposed to water for its use purpose, there is a high probability of failure or malfunction in the speaker exposed to the outside.

DISCLOSURE

Technical Problem

An aspect of the present disclosure is to provide a refrigerator having a speaker.

Another aspect of the present disclosure is to provide a refrigerator having a structure for protecting a speaker from water.

Another aspect of the present disclosure is to provide a refrigerator having a speaker capable of reducing damages of failure or malfunction since it is not easily exposed to the outside.

Technical Solution

In accordance with an aspect of the present disclosure, a refrigerator includes: a main body having an opening, and including a storage chamber therein; a door configured to open or close the opening; a speaker assembly disposed in the bottom of the door, and configured to output sound to the outside.

The door comprises a upper door, and a lower door disposed below the upper door, and the speaker assembly is disposed in the bottom of the upper door in such a way to face the upper surface of the lower door.

The speaker assembly comprises a speaker inclined at a predetermined angle with respect to the bottom of the upper door.

The speaker is inclined at a predetermine angle θ with respect to the bottom of the door, toward a front direction of the door.

The predetermined angle θ satisfies $0° < \theta \leq 45°$.

The speaker assembly includes: a speaker configured to generate sound; and an inclined resting portion inclined with respect to the bottom of the door toward a front direction of the door, wherein the speaker is disposed on the rear surface of the inclined resting portion.

The speaker assembly further comprises a speaker hole formed in the inclined resting portion, and configured to transfer sound output from the speaker to the outside.

The speaker assembly includes: an unit installing portion recessed upward from the bottom of the door, and forming installing space; and a speaker resting unit including the inclined resting portion, and disposed in the installing space. The speaker is disposed on one surface of the inclined resting portion in disposition space formed between the unit installing portion and the speaker resting unit.

The speaker resting unit comprises a guide portion extending from the inclined resting portion, and configured to guide sound generated from the speaker to be directed toward the front direction of the door.

The guide portion is spaced from the inclined resting portion in such a way to be inclined at an obtuse angle with respect to the inclined resting portion.

The speaker assembly comprises discharge space defined by the guide portion and the inclined resting portion, and recessed from the bottom of the door.

Advantageous Effects

The refrigerator according to the present disclosure can output sound to the outside through the speaker.

The refrigerator according to the present disclosure can improve the structure of the speaker to thereby prevent failure caused by moisture or water.

The refrigerator according to the present disclosure can minimize exposure of the speaker to thereby reduce influences by an external environment.

BRIEF DESCRIPTION OF THE DRAWINGS

FIG. 1 shows a refrigerator according to an embodiment of the present disclosure.

FIG. 2 is a perspective view of a refrigerator according to an embodiment of the present disclosure.

FIG. 3 is a bottom perspective view of a refrigerator door according to an embodiment of the present disclosure.

FIG. 4 is a cross-sectional view cut along a line A-A' of FIG. 1.

FIG. 5 is an enlarged view of FIG. 4.

FIG. 6 is an exploded perspective view of a speaker assembly according to an embodiment of the present disclosure.

FIG. 7 is a perspective view of a speaker resting unit according to an embodiment of the present disclosure.

FIG. 8 is a cross-sectional view of a refrigerator door according to another embodiment of the present disclosure.

FIG. 9 is an exploded perspective view of a speaker assembly according to another embodiment of the present disclosure.

BEST MODE

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise.

In this specification, it will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, embodiments of the present disclosure will be described in detail with reference to the accompanying drawings.

In general, a refrigerator is a home appliance including a storage chamber for storing food, and a cool-air supply apparatus for supplying cool air to the storage chamber, to store food fresh. The refrigerator can be classified into several types according to the locations of storage chambers and doors.

There are a Top Mounted Freezer (TMF) type refrigerator in which a storage chamber is partitioned into an upper freezing chamber and a lower refrigerating chamber by a horizontal partition wall, and a Bottom Mounted Freezer (BMF) type refrigerator having a refrigerating chamber in the upper portion and a freezing chamber in the lower portion.

Also, there are a Side By Side (SBS) type refrigerator in which a storage chamber is partitioned by a vertical partition wall into left and right sections; a freezing chamber and a refrigerating chamber, and a French Door Refrigerator (FDR) type refrigerator in which a storage chamber is partitioned by a horizontal partition wall into an upper refrigerating chamber and a lower freezing chamber, wherein the upper refrigerating chamber is opened or closed by a pair of doors.

Meanwhile, each door of the refrigerator may include a gasket to seal the gap between the door and the main body when the door closes.

In the FDR type refrigerator, since the upper refrigerating chamber is opened or closed by the pair of doors and includes no vertical partition wall, the gap formed between the pair of doors cannot be sealed by the gasket. Accordingly, in order to seal the gap formed between the doors, a method of rotatably installing a rotation bar in any one of the doors is suggested.

A refrigerator according to an embodiment of the present disclosure is, for convenience of description, assumed to be a FDR type refrigerator, although not limited to this.

FIG. 1 shows a refrigerator according to an embodiment of the present disclosure, and FIG. 2 is a perspective view of a refrigerator according to an embodiment of the present disclosure.

A refrigerator 1 may include a main body 10, a storage chamber 20 partitioned into an upper chamber and a lower chamber inside the main body 10, a door configured to open or close the storage chamber 20, and a cool-air supply apparatus (not shown) configured to supply cool air to the storage chamber 20.

The main body 10 may include an inner cabinet forming the storage chamber 20, an outer cabinet coupled with the outer side of the inner cabinet and forming the outer appearance of the refrigerator 1, and an insulator foamed between the inner cabinet and the outer cabinet, and configured to insulate the storage chamber 20.

The cool-air supply apparatus may generate cool air through a cooling circulation cycle of compressing, condensing, expanding, and evaporating refrigerants.

The front part of the storage chamber 20 may open, and the storage chamber 20 may be partitioned into an upper refrigerating chamber 22 and a lower freezing chamber 24 by a horizontal partition wall. The refrigerating chamber 22 may be opened or closed by a pair of doors 31 and 32 rotatably coupled with the main body 10, and the freezing chamber 24 may also be opened or closed by a pair of doors rotatably coupled with the main body 10. The shapes of the doors are not limited, and the doors may be sliding doors that slide to open or close.

The pair of doors 31 and 32 to open or close the refrigerating chamber 22 may be positioned from side to side. In the following description, for convenience of description, the left one of the doors 31 and 32 will be referred to as a first door 31, and the right one of the doors 31 and 31 will be referred to as a second door 32. Also, for convenience of description, the doors of the refrigerating chamber 22 will be referred to as upper doors 33, and the doors of the freezing chamber 24 will be referred to as lower doors 34.

The first door 31 may open or close the left area of the front opening 10 of the refrigerating chamber 22, and the second door 32 may open or close the remaining area of the front opening 10*a* of the refrigerating chamber 22. In each of the rear surfaces of the first door 31 and the second door 32, a door shelf 35 may be provided to store food therein.

The doors shelf 35 may include a shelf support 35*a* extending vertically from the first door 31 to support the door shelf 35 at its both left and right sides. The shelf support 35*a* may be removably connected to the doors 31 and 32. In the current embodiment, the shelf support 35*a* may extend from the doors 31 and 32.

Also, in the edges of the rear surfaces of the first and second doors 31 and 32, a gasket 36 may be provided to seal a gap between the first and second doors 31 and 32 and the main body 10 when the first and second doors 31 and 32 close.

The gasket 36 may be installed in the form of a loop along the edges of the rear surfaces of the first and second doors 31 and 32, and include a magnet (not shown) therein.

Meanwhile, a rotation bar 100 may be rotatably installed in the first door 31 in order to seal a gap made between the first and second doors 31 and 32 when the first and second doors 31 and 32 close. In the current embodiment, the rotation bar 100 is rotatably installed in the first door 31, however, the rotation bar 100 may be installed in the second door 32.

The rotation bar 100 may be in the shape of a bar extending in the height direction of the first door 31, and may be rotated by a guide member 50 installed in the main body 10.

FIG. 3 is a bottom perspective view of a refrigerator door according to an embodiment of the present disclosure, FIG. 4 is a cross-sectional view cut along a line A-A' of FIG. 1, FIG. 5 is an enlarged view of FIG. 4, FIG. 6 is an exploded perspective view of a speaker assembly according to an embodiment of the present disclosure, and FIG. 7 is a perspective view of a speaker resting unit according to an embodiment of the present disclosure.

The refrigerator 1 may include a speaker assembly 170.

The speaker assembly 170 may output sound to the outside of the refrigerator 1. The speaker assembly 170 may be installed in the bottom 33*a* of the upper door 33. Since the speaker assembly 170 is installed in the bottom 33*a* of the upper door 33, failure or malfunction caused by external influences can be minimized. Also, it is possible to prevent water from entering the inside of the speaker assembly 170. A speaker 172 (will be described later) of the speaker assembly 170 may receive an electrical signal from a controller (not shown), and output beep sound, melody, or voice for controlling the functions of the refrigerator 1, informing the opening or closing of the door 31, 32, or 34, or informing the pressing of a control button, to the outside.

More specifically, the speaker assembly 170 may be installed in the bottom 33*a* of the upper door 33 in such a way to face the upper surface 34*a* of the lower door 34. Sound output from the speaker assembly 170 installed in the bottom 33*a* of the upper door 33 may be directly transferred to the outside of the refrigerator 1, or may be reflected from the upper surface 34*a* of the lower door 34 and then transferred to the outside. Although the number or position of the speaker assembly 170 is not limited, in the current embodiment, a pair of speaker assemblies 170 may be installed in the bottom 33*a* of the upper door 33, with a vent 189 of a radiating duct (not shown) in between.

Referring to FIG. 6, the speaker assembly 170 may include the speaker 172, a base unit 180, and a speaker resting unit 190.

The base unit 180 may be disposed in the bottom 33*a* of the upper door 33 such that at least one part of the base unit 180 forms a portion of the upper door 33. The base unit 180 may include a first base portion 182 forming the bottom 33*a* of the upper door 33, and an unit installing portion 184 forming installing space 185 in which the speaker 172 is installed. The base unit 180 may form a part of the outer cabinet of the upper door 33 of the refrigerator 1. That is, the insulator may be foamed above the base unit 180, and the base unit 180 may function as a part of the outer cabinet in the bottom 33*a* of the upper door 33.

The first base portion 182 may form the bottom 33*a* of the upper door 33. In the first base portion 182, the unit installing portion 184 which will be described later may be formed.

The unit installing portion 184 may be disposed in the bottom 33*a* of the upper door 33, and form the installing space 185 in which the other components of the speaker assembly 170 can be installed. The first base portion 182 may be disposed around the unit installing portion 184. The recessed space of the unit installing portion 184 may correspond to the installing space 185, and the speaker 170 or the speaker resting unit 190 which will be described later may be installed in the installing space 185. That is, the unit installing portion 184 may partition the installing space 185 from the inside of the upper door 33.

The speaker 172 may be disposed in the installing space 185 in such a way to be inclined at a predetermined angle with respect to the bottom 33*a* of the upper door 33. More specifically, a sound output portion 172*a* of the speaker 172, from which sound is output, may be inclined at a predetermined angle with respect to the bottom 33*a* of the upper door 33, toward the front direction of the upper door 33. In other words, the sound output portion 172*a* of the speaker 172 may face the lower door 34 in such a way to be inclined toward the front direction of the upper door 33. That is, the sound output portion 172*a* of the speaker 172 may be inclined at a predetermined angle θ (see FIG. 5) upward with respect to the bottom 33*a* of the upper door 33.

Referring to FIG. 5, if the angle of the sound output portion 172*a* of the speaker 172 with respect to the bottom 33*a* of the upper door 33 is θ, $0° \leq \theta \leq 45°$. Through the configuration, the speaker assembly 170 can efficiently transfer sound toward the front direction of the upper door 33, in view of sound, and prevent the inflow of water while effectively expelling water, in view of maintenance.

The speaker resting unit 190 may be positioned in the installing space 185 to install the speaker 172 therein. Disposition space 187 in which the speaker 172 is installed may be formed between the speaker resting unit 190 and the unit installing portion 184.

The speaker resting unit 190 may include an inclined resting portion 194 and a guide portion 196.

The speaker 172 may be disposed on the rear surface of the inclined resting portion 194, and the inclined resting portion 194 may transfer sound output from the speaker 172 to the outside. In order to transfer sound output from the speaker 172 to the outside, the inclined resting portion 194 may include at least one speaker hole 195 that is in the shape of a hole. In the current embodiment, the speaker hole 195 may be in the shape of a plurality of holes whose longitudinal direction is the vertical direction. However, the shape, number, and arrangement of the speaker hole 195 are not limited to these, as long as the speaker hole 195 is formed in the inclined resting portion 194 and functions as a passage for transferring sound output from the speaker 172 to the outside. For example, the speaker hole 195 may be a plurality of holes, or in the shape of a mesh.

The speaker 172 may be rested on the rear surface of the inclined resting portion 194. However, a configuration in which the speaker 172 is rested on the inclined resting portion 194 is not limited. In the current embodiment, the speaker 172 may be screw-coupled with the inclined resting portion 194 at both sides.

The inclined resting portion 194 may be inclined toward the front direction of the upper door 33 with respect to the bottom 33*a* of the upper door 33. That is, the inclined resting portion 194 may be inclined at a predetermined angle θ (see FIG. 5) upward with respect to the bottom 33*a* of the upper door 33. The rear surface of the inclined resting portion 194 may face the sound output portion 172*a* of the speaker 172 to be in parallel with the sound output portion 172*a*. That is, the inclined resting portion 194 may also have a gradient of θ ($0° < \theta < 45°$), like the speaker 172. In the current embodiment, the sound output portion 172*a* of the speaker 172 may contact the rear surface of the inclined resting portion 194. Through the configuration, sound output from the sound output portion 172*a* of the speaker 172 may be transferred to the outside via the speaker hole 195 of the inclined resting portion 194, without being reflected against the inclined resting portion 194.

Since the inclined resting portion 194 is inclined with respect to the bottom 33*a* of the upper door 33, water can flow down the inclined resting portion 194, without remaining in the inclined resting portion 194, thereby preventing water from entering the disposition space 187. Also, since the disposition space 187 communicates with the outside through the speaker hole 195 of the inclined resting portion 194, water entered the disposition space 187 may be expelled through the speaker hole 195.

The guide portion 196 may extend from the inclined resting portion 194. The guide portion 196 may guide sound transferred through the speaker hole 195 to be directed in the front direction of the upper door 33. In order to guide sound transferred through the speaker hole 195 to be directed in the front direction of the upper door 33, the guide portion 196 may be spaced from the inclined resting portion 194 in such a way to be inclined at an obtuse angle with respect to the inclined resting portion 194. Between the guide portion 196 and the inclined resting portion 194, discharge space 197 may be formed to transfer sound generated by the speaker 172 to the outside.

The unit installing portion 184 may correspond to the inclined resting portion 194 and the guide portion 196 of the speaker resting unit 190, as described above. More specifically, the unit installing portion 184 may include a first inner surface 184*a* positioned in parallel with the inclined resting portion 194, and a second inner surface 184*b* positioned in parallel with the guide portion 196. Through the configuration, unnecessary space may be prevented from being formed in the disposition space 187 so that sound can be efficiently transferred to the outside.

The speaker resting unit 190 may include a second base portion 192. The second base portion 192 may be formed around the inclined resting portion 194 and the guide portion 196. The second base portion 192 may be positioned in parallel with the bottom 33*a* of the upper door 33, and face the first base portion 182. In the current embodiment, the second base portion 192 may contact the first base portion 182, so as to stably support the inclined resting portion 194 and the guide portion 196 on the unit installing portion 184.

The unit installing portion 184 may include an installing recess 186 which is recessed along the opening of the installing space 185. The speaker resting unit 190 may contact the installing recess 186 to be rested on the unit installing portion 184.

More specifically, the installing recess 186 may include a first contact surface 186*a* stepped from the lower surface of the unit installing portion 184, and a second contact surface 186*b* connecting the first contact surface 186*a* to the lower surface of the unit installing portion 184 and formed vertically to the first contact surface 186*a*.

The speaker resting unit 190 may contact the first contact surface 186*a* and the second contact surface 186*b* along the circumference so as to be rested on the unit installing portion 184. Through the configuration, the disposition space 187 formed by the speaker resting unit 190 and the unit installing portion 184 may be sealed, and the disposition space 187 may communicate with the outside only through the speaker hole 195.

The speaker resting unit 190 may be coupled with the unit installing portion 184 by a coupling member such as a screw so as to be rested on the unit installing portion 184.

Hereinafter, the refrigerator 1 according to another embodiment of the present disclosure will be described. In the following description, descriptions about the same components as those described above will be omitted.

FIG. 8 is a cross-sectional view of a refrigerator door according to another embodiment of the present disclosure, and FIG. 9 is an exploded perspective view of a speaker assembly according to another embodiment of the present disclosure.

The refrigerator 1 may include a speaker assembly 270.

The speaker assembly 270 may include a speaker 272, a base unit 280, and a speaker resting unit 290. The base unit 280 may include a first base portion 282 forming the bottom 33*a* of the upper door 33, and an unit installing portion 284 in which the speaker 272 is installed.

The unit installing portion 284 may be disposed in the bottom 33*a* of the upper door 33, and form installing space 285 in which the other components of the speaker assembly 270 can be installed. The first base portion 282 may be disposed around the unit installing portion 284. The recessed space of the unit installing portion 284 may be installing space 285 to accommodate the speaker 272 or the speaker resting unit 290 which will be described later. That is, the unit installing portion 284 may partition the installing space 285 from the inside of the upper door 33.

The speaker 272 may be disposed in the installing space 285 to be in parallel with the bottom 33*a* of the lower door 33. More specifically, a sound output portion 272*a* of the speaker 272, from which sound is output, may be in parallel with the bottom 33*a* of the upper door 33. In other words, the sound output portion 272*a* may face the lower door 34.

Through the configuration, the speaker assembly 270 may can efficiently transfer sound toward the front direction of the upper door 33, in view of sound, and prevent the inflow of water while effectively expelling water, in view of maintenance.

The speaker resting unit 290 may be disposed in the installing space 285 to install the speaker 272 therein. Disposition space 287 in which the speaker 272 is installed may be formed between the speaker resting unit 290 and the unit installing portion 284.

The speaker resting unit 290 may include a resting portion 294.

The speaker 272 may be disposed on the rear surface of the resting portion 294, and the resting portion 290 may transfer sound output from the speaker 272 to the outside. The resting portion 290 may include at least one speaker hole 295 that is in the shape of a hole. In the current embodiment, the speaker hole 295 may be in the shape of a plurality of holes whose longitudinal direction is the vertical direction. However, the shape, number, and arrangement of the speaker hole 295 are not limited to these, as long as the speaker hole 295 is formed in the resting portion 294 and functions as a passage for transferring sound output from the speaker 272 to the outside. For example, the speaker hole 295 may be a plurality of holes, or in the shape of a mesh.

The speaker 272 may be rested on the rear surface of the resting portion 294. However, a configuration in which the speaker 272 is rested on the inclined resting portion 294 is not limited. In the current embodiment, the speaker 272 may be screw-coupled with the speaker resting unit 290 at both sides.

The resting portion 294 may be disposed in parallel with the bottom 33*a* of the upper door 33. The rear surface of the resting portion 294 may face the sound output portion 272*a* of the speaker 272 to be in parallel with the sound output portion 272*a*. In the current embodiment, the sound output portion 272*a* of the speaker 272 may contact the rear surface of the resting portion 294. Through the configuration, sound output from the sound output portion 272*a* of the speaker 272 may be transferred to the outside via the speaker hole 295 of the resting portion 294, without being reflected against the resting portion 294.

Since the resting portion 294 is positioned in parallel with respect to the bottom 33*a* of the upper door 33, water can flow down the resting portion 294, without remaining in the resting portion 294, thereby preventing water from entering the disposition space 287. Also, since the disposition space 287 communicates with the outside through the speaker hole 295 of the resting portion 294, water entered the disposition space 287 may be expelled through the speaker hole 295.

The unit installing portion 284 may correspond to the resting portion 294 of the speaker resting unit 290 as described above. More specifically, the unit installing portion 284 may include an inner surface 284*a* positioned in parallel with the resting portion 294. Through the configuration, unnecessary space may be prevented from being formed in the disposition space 287 so that sound can be efficiently transferred to the outside.

The unit installing portion 284 may include an installing recess 286 which is recessed along the opening of the installing space 285. The speaker resting unit 290 may contact the installing recess 286 to be rested on the unit installing portion 284.

More specifically, the installing recess 286 may include a first contact surface 286*a* stepped from the lower surface of the unit installing portion 284, and a second contact surface 286*b* connecting the first contact surface 286*a* to the lower surface of the unit installing portion 284 and formed vertically to the first contact surface 286*a*.

The speaker resting unit 290 may contact the first contact surface 286*a* and the second contact surface 286*b* along the circumference so as to be rested on the unit installing portion 284. Through the configuration, the disposition space 287 formed by the speaker resting unit 290 and the unit installing portion 284 may be sealed, and the disposition space 287 may communicate with the outside only through the speaker hole 295.

The speaker resting unit 290 may be coupled with the unit installing portion 284 by a coupling member such as a screw so as to be rested on the unit installing portion 284.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A refrigerator comprising:

a main body having a storage chamber therein;

a door having an upper door and a lower door provided below the upper door and configured to open or close the storage chamber; and a speaker assembly disposed in a recess in a bottom of the upper door in such a way to face an upper surface of the lower door, and configured to output sound to an outside of the refrigerator, wherein the speaker assembly comprises:

a base unit configured to be a portion of an outer cabinet of the door and comprising a base portion forming the bottom of the upper door by extending from a lower front portion of the recess to a lower rear portion of the recess, and a unit installing portion recessed from the base portion and forming an installing space;

a speaker disposed in the installing space and inclined at a predetermined angle with respect to the base portion; and a speaker resting unit configured to cover the installing space to prevent exposure of the speaker, and wherein the recess is covered from the outside of the refrigerator by the speaker assembly.

2. The refrigerator according to claim 1, wherein the predetermined angle satisfies $0° < \theta \leq 45°$.

3. The refrigerator according to claim 1, wherein the speaker resting unit includes an inclined resting portion having the speaker disposed on a rear surface thereof and formed to be inclined at a predetermined angle toward a front direction of the upper door from the bottom of the upper door.

4. The refrigerator according to claim 3, wherein the inclined resting portion further comprises a speaker hole configured to transfer sound output from the speaker to the outside.

5. The refrigerator according to claim 3, wherein the speaker resting unit further comprises a guide portion extending from the inclined resting portion, and configured to guide sound generated from the speaker to be directed toward the front direction of the upper door.

6. The refrigerator according to claim 5, wherein the guide portion and the inclined resting portion form an obtuse angle.

7. The refrigerator according to claim 1, wherein:

the unit installing portion comprises an installing recess which is recessed along a periphery thereof; and the speaker resting unit is configured such that a periphery thereof is inserted into the installing recess.

8. A refrigerator comprising:

a main body having a storage chamber therein;

a door having an upper door and a lower door provided below the upper door and configured to open or close the storage chamber; and a speaker assembly disposed in a recess in a bottom of the upper door in such a way to face an upper surface of the lower door, and configured to output sound to an outside of the refrigerator, wherein the speaker assembly comprises:

a base unit forming a portion of a lower surface of the upper door by extending from a lower front portion of the recess to a lower rear portion of the recess and forming an installing space recessed from the lower surface of the upper door;

a speaker resting unit configured to cover the installing space; and a speaker provided inside the speaker resting unit, wherein the recess is sealed from the outside of the refrigerator by the speaker assembly.

9. The refrigerator according to claim 8, wherein the speaker resting unit comprises an inclined resting portion having the speaker disposed on a rear surface thereof and formed in parallel to the speaker for resting of the speaker.

10. The refrigerator according to claim 9, wherein the inclined resting portion further comprises a speaker hole configured to transfer sound output from the speaker to the outside.

11. The refrigerator according to claim 9, wherein the speaker resting unit further comprises a guide portion extending from the inclined resting portion, and configured to guide sound generated from the speaker to be directed toward the front direction of the upper door.

12. The refrigerator according to claim 11, wherein the guide portion and the inclined resting portion form an obtuse angle.

13. A refrigerator comprising:

a main body having an upper storage chamber and a lower storage chamber therein;

a first door configured to open or close the upper storage chamber and having a lower surface and a recess extending from the lower surface;

a second door configured to open or close the lower storage chamber; and a speaker assembly disposed in the recess in the bottom of the first door in such a way to face an upper surface of the second door, wherein the speaker assembly comprises:

a speaker configured to output sound; and an inclined resting portion in which the speaker is rested, and inclined at a predetermined angle toward a front direction of the first door from a lower surface of the first door such that the speaker is inclined at the predetermined angle towards a front surface of the first door, wherein the recess is sealed from an outside of the refrigerator by the speaker assembly.

* * * * *